US008505921B2

(12) United States Patent
Amodt

(10) Patent No.: US 8,505,921 B2
(45) Date of Patent: Aug. 13, 2013

(54) PORTA-FOLD TARGET STAND SYSTEM

(76) Inventor: David R. Amodt, St. George, UT (US)

( * ) Notice: Subject to any disclaimer, the term of this patent is extended or adjusted under 35 U.S.C. 154(b) by 267 days.

(21) Appl. No.: 12/930,698

(22) Filed: Jan. 13, 2011

(65) Prior Publication Data

US 2011/0175294 A1 Jul. 21, 2011

Related U.S. Application Data

(60) Provisional application No. 61/336,139, filed on Jan. 15, 2010.

(51) Int. Cl.
*F41J 1/10* (2006.01)

(52) U.S. Cl.
USPC ..... 273/407

(58) Field of Classification Search
USPC ..... 273/398–402, 390–392, 406, 407; 473/476–478, 454–456
See application file for complete search history.

(56) References Cited

U.S. PATENT DOCUMENTS

| | | | | | |
|---|---|---|---|---|---|
| 2,538,118 | A * | 1/1951 | Miller | 273/407 |
| 3,080,166 | A * | 3/1963 | Clark | 273/407 |
| 3,087,701 | A * | 4/1963 | Wallace | 248/166 |
| 3,427,026 | A * | 2/1969 | Mahoney | 473/435 |
| 4,813,684 | A * | 3/1989 | Bruno | 273/403 |
| 5,584,480 | A * | 12/1996 | Grimsrud | 473/416 |
| 5,598,996 | A * | 2/1997 | Rath | 248/163.1 |
| 5,676,378 | A * | 10/1997 | West | 273/390 |
| 5,816,579 | A * | 10/1998 | Broussard et al. | 273/408 |
| 5,906,552 | A * | 5/1999 | Padilla | 473/421 |
| 5,947,477 | A * | 9/1999 | Turnipseed | 273/407 |
| 5,967,523 | A * | 10/1999 | Brownlee | 273/407 |
| 7,011,310 | B2 * | 3/2006 | Rowan | 273/398 |
| 7,959,154 | B2 * | 6/2011 | Ball | 273/407 |
| 8,162,320 | B2 * | 4/2012 | Medina et al. | 273/407 |
| 8,286,968 | B2 * | 10/2012 | Duerr | 273/407 |

* cited by examiner

*Primary Examiner* — Mark Graham
(74) *Attorney, Agent, or Firm* — Michael J. Foycik, Jr.

(57) ABSTRACT

A target stand includes a target stand base and a target holder, together with a target mounted in the holder. The base has a cross member which is adjustably rotatably mounted, and the cross member has an upright member extending therefrom. The holder has a stem portion inserted into an open end of the upright portion of the base. A hand screw is used to secure the stem portion in the upright member. In this manner, the holder can be secured at any rotational angle relative to the upright member. Further, the upright member itself can be moved to any position by rotation of the cross member, which is likewise secured by a hand screw. Further, an uppermost portion of the target stand holder includes block carrying a transverse bar and allowing pivoting of the transverse bar. The transverse bar connects a pair of upright bars.

5 Claims, 5 Drawing Sheets

PORTA-FOLD TARGET STAND SYSTEM

CLAIM FOR PRIORITY AND CROSS-REFERENCE TO RELATED APPLICATIONS

This application claims the priority of Provisional Patent Application Ser. No. 61/336,139, filed on Jan. 15, 2010.

STATEMENT REGARDING FEDERALLY SPONSORED RESEARCH OR DEVELOPMENT

Not applicable.

FIELD OF THE INVENTION

The present invention relates generally to a portable folding target stand system for holding standard targets for use as a target for arrows, bullets, or other projectiles. The system includes accessories compatible with a main base.

BACKGROUND OF THE INVENTION

Targets are well known for use with arrows, bullets, and other projectiles. Such targets known in the prior art include paper targets with printed outlines such as a bulls eye, and solid targets such as tin cans, sand bags, and water bottles. Various stands have been used in the prior art, such as suspended wires, solid tables, and bales of hay.

However, for use in the wild or on a range, it is cumbersome and difficult to carry along a large or bulky target stand.

Furthermore, it is a problem in the art to provide a portable, easy to assemble target stand that can carry any of a number of accessories.

It is accordingly a problem in the prior art to provide a device or system providing a portable target stand with a plurality of accessories, which is useful and easier to use, with ease of assembly and non-bulky.

SUMMARY OF THE INVENTION

From the foregoing, it is seen that it is a problem in the art to provide a device meeting the above requirements.

According to the present invention, a device is provided which meets the aforementioned requirements and needs in the prior art. Specifically, the device according to the present invention provides portable, easy to assemble target stand that can carry any of a number of accessories.

The device according to the present invention includes a portable target stand with a plurality of accessories, which is useful and easier to use, with ease of assembly and non-bulky. The target stand includes a base portion, an upright portion which is foldable to the level of the base, and a holder which is adjustably connectable to the upright portion.

Other objects and advantages of the present invention will be more readily apparent from the following detailed description when read in conjunction with the accompanying drawings.

DETAILED DESCRIPTION OF THE INVENTION

Figure 1A:
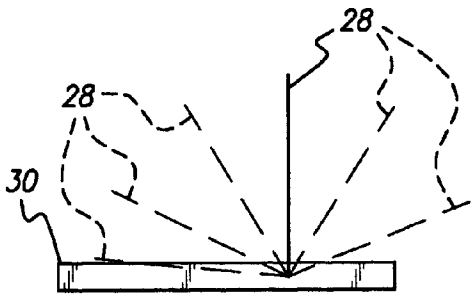
FIG. 1A is a schematic side view showing the range of motion of the upright portion relative to the frame portion.
Figure 1:
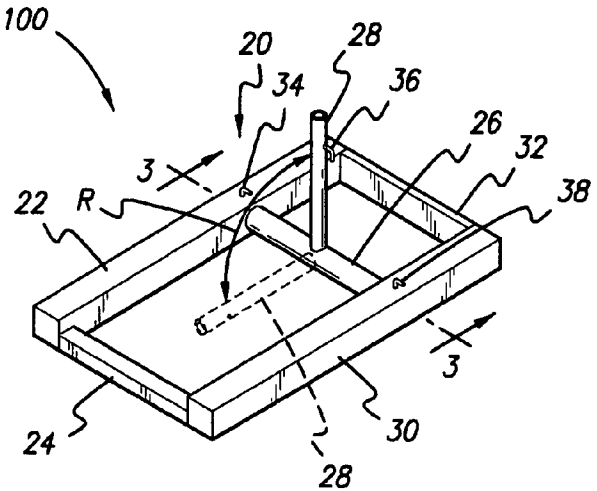
FIG. 1 is a schematic, perspective view of a target stand base and upright portion, according to the present invention.

FIG. 1 is a schematic, perspective view of a target stand base 100 having a frame portion 20 and a cross member 26 having an upright portion 28 connected thereto. The frame portion 20 is formed by four frame members 22, 24, 30, and 32 forming a generally rectangular configuration.

Figure 2:
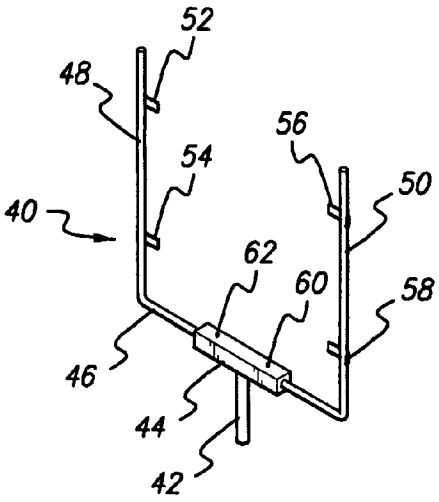
FIG. 2 is a schematic, perspective view of a holder for use with the target stand and upright portion of FIG. 1.
Figure 3:
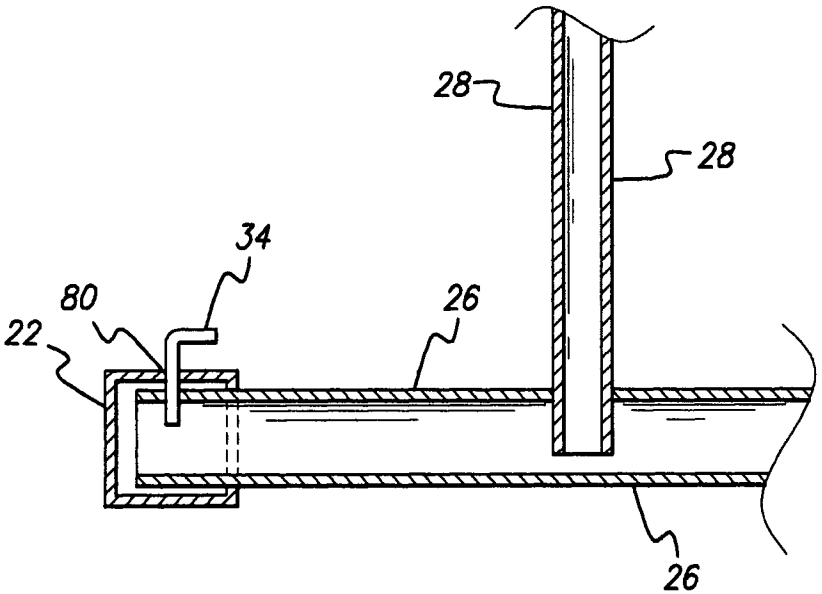
FIG. 3 is a schematic sectional view taken along line 3-3 of FIG. 1.

The cross member 26 is adjustably rotatably mounted on the frame portion 20 as indicated by the arrow R in FIG. 1, and is secured in position by a pair of hand screws 34, 38 (shown in greater detail in FIG. 3). The upright portion 28 is hollow and has an uppermost end which is open so as to receive a stem portion 42 of a holder 40 (shown in FIG. 2). The upright portion 28 carries a hand screw 36 for securing the stem portion 42 of the holder 40 when the stem portion 42 is inserted into the open end of the upright portion 28.

The four frame members 22, 24, 30, and 32 are preferably hollow with rectangular cross sections, and composed of metal, and the metal can be coated such as with powder coating. However, other types of cross section can be used, and the members can be solid instead of hollow; and the members can be made of other types of materials such as plastic or ceramic. The frame members 22, 24, 30, and 32 are preferably connected by welding, but can be secured by other means as well, including by bolts, screws, dovetail joints, or other connecting means known to anyone skilled in the metal working arts. All such variations are contemplated as being within the scope of the present invention.

FIG. 1A is a schematic side view showing the upright portion 28 in an upright position as a solid line, and in dashed form to indicate a plurality of positions which indicate the range of motion of the upright portion 28 relative to the frame portion 20. The positions shown are merely indicative of the full range of motion, and other positions can be locked in besides those shown. In the folded position of the target stand base 100, the upright portion 28 is substantially parallel to and disposed within a plane containing the frame portion 20.

FIG. 2 is a schematic, perspective view of a holder 40 for use with the target stand base 100 and upright portion 28 of FIG. 1. The holder 40 includes a stem portion 42 connected to a support block 44, a transverse bar 46 rotatably supported by the support block 44, a transverse bar 46, and a pair of upright bars 48, 50 connected at opposite ends of the transverse bar 46. Retaining members 52 and 54 are mounted on the upright bar 48, and retaining members 56 and 58 are mounted on the upright bar 50. The retaining members 52, 54, 56, and 58 are used to retain a target (not shown in FIG. 2) on the holder 40 between the upright bars 48, 50.

The transverse bar 46 is adjustably rotatably supported by a support block 44 and is changeable by simple manual adjustment, the support block 44 being frictionally supported against movement by the action of a pair of set screws 60, 62. The screws 60, 62 pass through the support block 44 and press against the transverse bar 46 so that it is frictionally retained against rotational movement.

In use, manual pressure against one of the upright bars 48, 50 that is sufficiently strong will cause the rotation of the transverse bar 46 relative to the support block 44, until the upright bars 48, 50 are in a desired position. The screws 60, 62 can be adjusted to provide the desired amount of frictional resistance.

FIG. 3 is a schematic sectional view taken along line 3-3 of FIG. 1, showing passage of one end of the cross member 26 through the side wall of the hollow frame member 22. A threaded bore 80 passes through the top wall of the frame member 22. The upright portion 28 is fixedly connected to the cross member 26 by welding, or other securement means such as shrink fitting, adhesive cement, threaded engagement or other manner known to anyone skilled in the metal working arts.

The hand screw 34 has a threaded portion which passes through the threaded bore 80 and is threadedly engaged therewith, and a tip of the hand screw 34 presses against the end of the cross member 26 so that manual rotation of the hand screw 34 tightens or loosens the pressure against the cross member 26 so that rotation of the cross member 26 is either prevented or permitted. The hand screw 38 is substantially identical in form and operation.

In use, the hand screws 34, 38 are loosened to permit folding of the target stand base 100 and holder 40. During setup of the target stand base 100 and holder 40, when the upright portion 28 is moved to the desired position, the hand screws 34, 38 are tightened to lock the cross member 26 against rotation.

Figure 4:
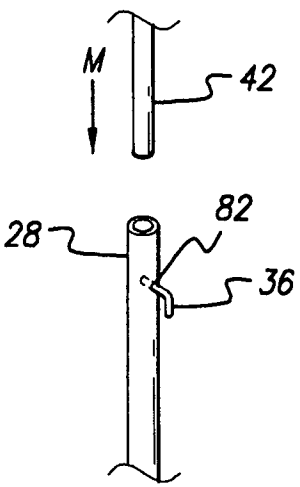
FIG. 4 is an assembly view of the base of the holder of FIG. 2 being inserted into the upright portion of FIG. 1.

FIG. 4 is an assembly view of the stem portion 42 of the holder 40 of FIG. 2, as it is being inserted into the open end of the upright portion 28 of FIG. 1. In this view, a hand screw 36 is shown which is in threaded engagement with a threaded bore 82 in the wall of the upright portion 28. The hand screw 36 operates similarly to the hand screw 34 described with respect to FIG. 3. In use, the stem portion 42 is inserted into the open end of the upright portion 28 to a desired depth, after which the hand screw 36 is tightened to secure the stem portion 42 in position. Also, the hand screw 36 can be loosened to permit removal of the stem portion 42 from the upright portion 28, and also to permit rotational turning of the stem portion 42 about its longitudinal axis which can be desirable for oriented a target held by the holder 40.

Figure 5A:
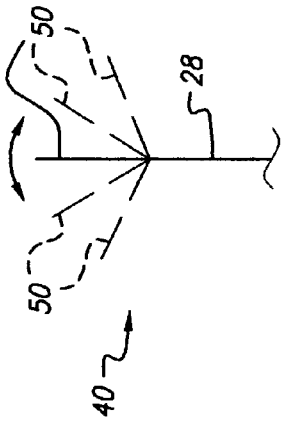
FIG. 5A is a schematic side view depicting the functional range of motion of the uppermost portion of the holder of FIG. 5.
Figure 5:
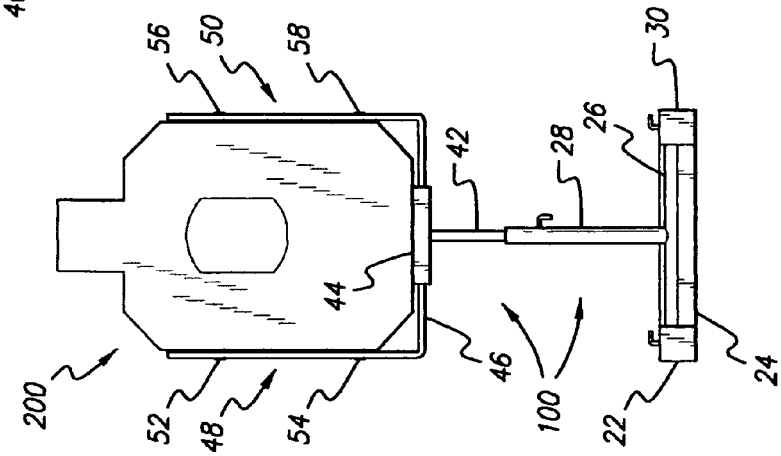
FIG. 5 is a schematic front elevational view of the assembled target stand of FIG. 1 and holder of FIG. 2, together with a target mounted in the holder.

FIG. 5 is a schematic front elevational view of the assembled target stand base 100 of FIG. 1 and the holder 40 of FIG. 2, together with a target 200 mounted in the holder 40. In this view, the holder 40 is oriented so that the target fully faces the front of the target stand base 100, but can be oriented at an angle about both a vertical axis (via rotation of the stem portion 42 relative to the upright portion 28 as described above) and a horizontal axis (via rotation of the transverse bar 46 relative to the support block 44, also as described above). Additionally, the holder 40 carrying the target 200 can be angled forward or backward by pivoting action of the upright portion 28 relative to the frame portion 20, also as described hereinabove.

The height of the target 200 held by the holder 40 can be adjusted, for example, in a range between two feet and five feet from the ground. Exemplary dimensions of the target stand base 100 are 20 inches by 30 inches, and the upright portion 28 height is 18 inches. However, all such dimensions are merely exemplary, and can be varied in relative proportions as well as in overall dimensions of length, width, and height. All such variations are contemplated as being within the scope of the present invention.

FIG. 5A is a schematic side view depicting the functional range of motion of the uppermost portion of the holder 40 of FIG. 5. In this view, the upright bar 50 of the holder 40 is visible, and the upright position is shown in solid, and other positions are shown in dashed outline. The positions shown are merely exemplary, and are intended to show an exemplary range of motion of the upright bars 48, 50 which carry the target 200.

Figure 6:
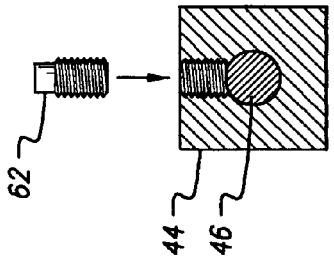
FIG. 6 is a schematic sectional side view of a portion of the holder of FIG. 5 including a screw holding a crosspiece of the holder in a support portion.

FIG. 6 is a schematic sectional side view of a portion of the support block 44 of the holder 40 of FIG. 5, including the screw 62 which frictionally retains the crossbar 46 of the holder 40 in a support portion. The other set screw 60 is substantially identical. In an alternative embodiment, other constructions can be provided and can include resilient material between the end of the screw 62 and the transverse bar 46 to improve the frictional grip therebetween.

Figure 7:
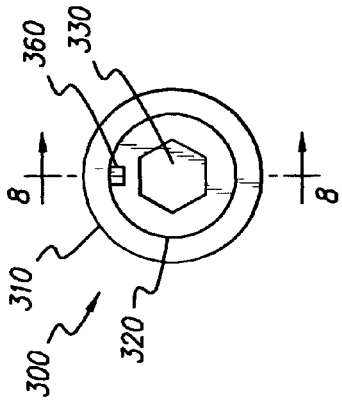
FIG. 7 is a schematic front elevational view of a member for use in an alternative construction of the base.

FIG. 7 is a schematic front elevational view of a member 300 for use in an alternative construction of the base 20. The member 300 is used to receive an end of a cross member 26A (shown in FIG. 12). The member 30 has a casing 310 having a fixed guide fin projection 360, supporting a movable block 320. The movable block 320 has a slot therein (unnumbered) which receives the fin projection 360 so as to guide movement of the block 320 and to prevent relative rotation between the block 320 and the casing 310. A hexagonal recess 330 formed in the movable block 320 is adapted to receive a hexagonal projection 27A of the cross member 26A. While a hexagonal shape is shown, other shapes can be used, such as octagonal, star-shaped, or formed with a plurality of separate unconnected recesses such as a plurality of linear slots. All such shapes are contemplated as being within the scope of the present invention. The recess 330 is intended to matingly receive a projection 27A of a cross member 26A (shown in FIG. 12), and therefore whatever shape is chosen for the recess 330, the projection 27A will necessarily have a mating shape. The use of the member 300 is illustrated in FIGS. 8-12 as discussed further hereunder.

Figure 8:
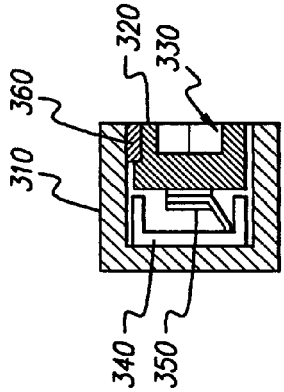
FIG. 8 is a schematic sectional side view taken along line 7-7 of the member of FIG. 7.

FIG. 8 is a schematic sectional side view taken along line 7-7 of the member 300 of FIG. 7. In this view, the interior of the casing 310 is shown, and includes a spring element 350 supported on a spring base 340. The spring element 350 urges the member 300 toward the right as seen in FIG. 8, while the guide fin projection 360 guides the movement of the member 300 and at the same time prevents relative rotation between the casing 310 and the movable block 320.

Figure 9:
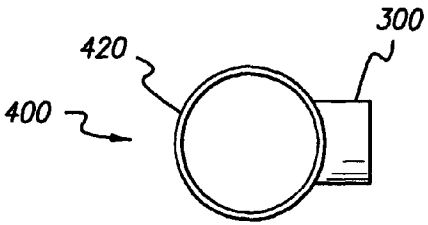
FIG. 9 is a schematic end elevational view of a connecting sleeve for carrying the member of the alternative embodiment of FIG. 7.

FIG. 9 is a schematic end elevational view of a connecting sleeve 400 for carrying the member 300 of the alternative embodiment of FIG. 7. The sleeve 400 has a cylindrical wall 420 having an interior 410 adapted to receive a frame member having a cylindrical outer surface. While a cylindrical shape is shown for the cylindrical wall 420, it could have other shapes such as a rectangular shape to receive a rectangular frame member, and all such variations in shape are contemplated as being within the scope of the present invention.

Figure 10:
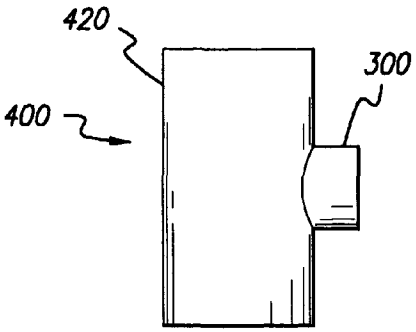
FIG. 10 is a schematic side elevational view of the connecting sleeve of FIG. 9, for carrying the member of the alternative embodiment of FIG. 7.

FIG. 10 is a schematic side elevational view of the connecting sleeve 400 of FIG. 9, for carrying the member 300 of the alternative embodiment of FIG. 7. As stated above, while a cylindrical shape is shown for the cylindrical wall 420, it could have other shapes such as a rectangular shape to receive a rectangular frame member, and all such variations in shape are contemplated as being within the scope of the present invention.

Figure 11:
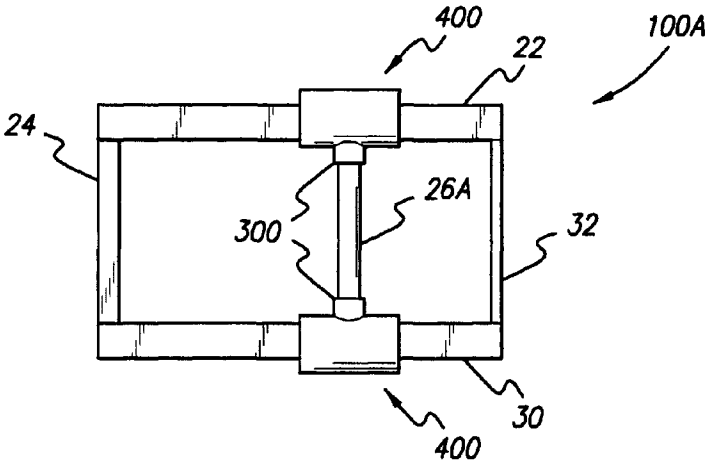
FIG. 11 is a schematic top elevational view of the assembly of an alternative base portion using the sleeve of FIG. 9.

FIG. 11 is a schematic top elevational view of the assembly of an alternative base 100A using a pair of sleeves 400, 400 of the type shown in FIG. 9. In this assembly, the sleeves 400, 400 are placed on respective ones of the frame members 22 and 30, and the remaining frame members 24 and 32 are connected so as to form the alternative target stand base 100A. A cross member 26A (shown in FIG. 12) is removably inserted between the sleeves 400, 400, by making room for it by pressing either or both of the blocks 320 against its respective spring base 340.

When the cross member 26A is inserted, release of pressure against the blocks 320 allows them to return to their original positions, so as to secure the cross member 26A therebetween. In order to fully secure the cross member 26A against rotation and to ensure a secure fit, opposite ends of the cross member 26A have a protrusion 27A (shown in FIG. 12) which mates with the recess 330 of each block 320. An advantage of this construction is to make the original construction of the target stand base 100A simpler and require fewer welds, and to make the cross member 26A fully removable.

Figure 12:
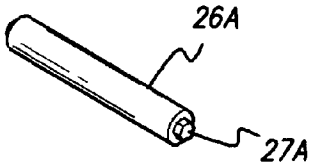
FIG. 12 is a schematic perspective view of an alternative embodiment of a cross member for the base portion, having an end adapted for engagement with the member of FIG. 7.

FIG. 12 is a schematic perspective view of an alternative embodiment of a cross member 26A for use with the base portion 100A, the cross member 26A having an end 27A adapted for engagement with the recess 330 of the member 300 of FIG. 7. While a hexagonal shape for the end 27A is shown, other shapes can be used, such as octagonal, star-shaped, or formed with a plurality of separate unconnected recesses such as a plurality of linear slots. All such shapes are contemplated as being within the scope of the present invention. Whichever shape is chosen for the end 27A, the recess 330 will necessarily have a mating shape.

Figure 13:
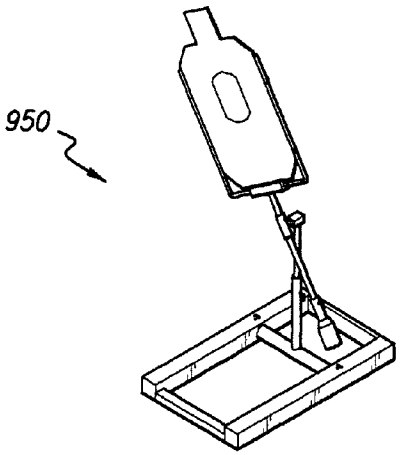
FIG. 13 is a schematic perspective view of an accessory for the target stand of FIG. 3, having a swinging pendulum.

FIG. 13 is a schematic perspective view of an accessory for the target stand of FIG. 3, having a swinging pendulum 950.

Figure 14:
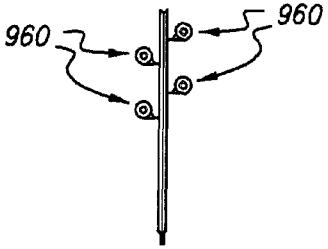
FIG. 14 is a schematic perspective view of an accessory for the target stand of FIG. 3, having a dual purpose dueling tree.

FIG. 14 is a schematic perspective view of an accessory for the target stand of FIG. 3, having a dual purpose dueling tree 960.

Figure 15:
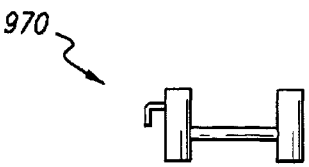
FIG. 15 is a schematic perspective view of an accessory for the target stand of FIG. 3, having an extra target connector.

FIG. 15 is a schematic perspective view of an accessory for the target stand of FIG. 3, having an extra target connector 970.

Figure 16A:
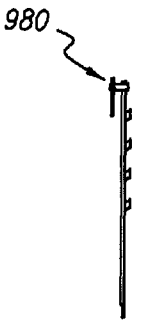
FIG. 16A is a schematic side view of an accessory for the target stand of FIG. 3, having a plurality of challenging plates.

FIG. 16A is a schematic side view of an accessory for the target stand of FIG. 3, having a plurality of challenging plates 980.

Figure 16B:
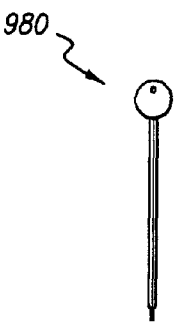
FIG. 16B is a schematic front view of the accessory of FIG. 16B.

FIG. 16B is a schematic front view of the plates 980 of FIG. 16B.

Figure 17:
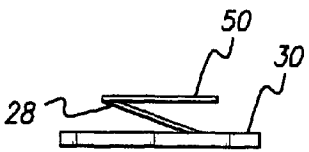
FIG. 17 is a schematic side view of the target stand base and holder in a completely folded configuration.

FIG. 17 is a schematic side view of the target stand base 100 and holder 40 in a completely folded configuration, showing the frame member 30, upright portion 28, and upright bar 50 in side view.

The invention being thus described, it will be evident that the same may be varied in many ways by a routineer in the applicable arts. Such variations are not to be regarded as a departure from the spirit and scope of the invention and all such modifications are intended to be included within the scope of the claims.

What is claimed is:

1. A collapsible target stand for supporting a removable target, comprising:

a target stand base comprising a frame portion which includes a rectangular frame portion which includes a plurality of frame members, said plurality of frame members including a front and rear pair of frame members connected by a pair of opposed side frame members, and said target stand base further comprising a cross member having opposed ends, wherein said opposed ends are respectively rotatably connected at an intermediate portion of each of said pair of opposed side frame members such that said cross member can be rotated manually to a selected position, a pair of manually operable screw members connected to respective ones of said pair of opposed side frame members, and which are operable to engage said cross member when manually turned for providing pressure against said cross member to retain it in the selected position;

wherein said cross member is adjustably rotatably mounted relative to said plurality of frame members, and further comprising an upright member fixedly connected to and extending from said cross member;

a target holder adapted to support a removable target, said target holder having a stem portion adapted to be detachably connected to one end of said upright member, a block portion, and a transverse member passing through said block portion and being frictionally retained within said block portion; and said transverse member of said target holder having opposed ends and including a pair of upright arms extending from said opposed ends of said transverse member, said pair of upright arms being adapted to hold the removable target therebetween, whereby said target can be moved to a collapsed position when said pair of manually operable screw members are turned so as to relieve pressure on said cross member and can be moved to an upright position and secured in place in the upright position by tightening of said manually operable screw members.

2. A target stand as claimed in claim 1, wherein said manually operable screw members each comprise a hand screw for securing the cross member against rotation relative to the frame members.

3. A target stand as claimed in claim 1, further comprising a hand screw for securing the transverse member against rotation relative to the block portion of the holder.

4. A target stand as claimed in claim 1, wherein the frame members are hollow rectangular members.

5. A target stand as claimed in claim 4, wherein the frame members are composed of metal, and are joined together by welding.

* * * * *